US009378638B2

(12) United States Patent
Maity et al.

(10) Patent No.: US 9,378,638 B2
(45) Date of Patent: Jun. 28, 2016

(54) EMERGENCY ALERT SYSTEM USING MANAGEMENT CONTROLLER IN NETWORK

(71) Applicant: AMERICAN MEGATRENDS, INC., Norcross, GA (US)

(72) Inventors: Sanjoy Maity, Snellville, GA (US); Varadachari Sudan Ayanam, Suwanee, GA (US); Samvinesh Christopher, Suwanee, GA (US); Baskar Parthiban, Johns Creek, GA (US)

(73) Assignee: AMERICAN MEGATRENDS, INC., Norcross, GA (US)

( * ) Notice: Subject to any disclaimer, the term of this patent is extended or adjusted under 35 U.S.C. 154(b) by 165 days.

(21) Appl. No.: 13/909,514

(22) Filed: Jun. 4, 2013

(65) Prior Publication Data

US 2014/0354442 A1 Dec. 4, 2014

(51) Int. Cl.
*G08B 3/00* (2006.01)
*G08B 27/00* (2006.01)

(52) U.S. Cl.
CPC ..... *G08B 27/005* (2013.01)

(58) Field of Classification Search
None
See application file for complete search history.

(56) References Cited

U.S. PATENT DOCUMENTS

| | | | | |
|---|---|---|---|---|
| 2006/0130100 | A1* | 6/2006 | Pentland | 725/68 |
| 2009/0199232 | A1* | 8/2009 | Takeyama et al. | 725/33 |
| 2009/0228917 | A1* | 9/2009 | Yun | 725/33 |
| 2009/0299857 | A1* | 12/2009 | Brubaker | 705/14.66 |
| 2011/0169634 | A1* | 7/2011 | Raj et al. | 340/540 |
| 2012/0136920 | A1* | 5/2012 | Rosentel et al. | 709/203 |
| 2013/0132170 | A1* | 5/2013 | Yelisetti et al. | 705/14.4 |
| 2013/0278385 | A1* | 10/2013 | Baskin et al. | 340/7.51 |
| 2013/0307975 | A1* | 11/2013 | Ford et al. | 348/143 |
| 2013/0347031 | A1* | 12/2013 | Hasek et al. | 725/33 |
| 2014/0059594 | A1* | 2/2014 | Stein | 725/33 |
| 2014/0095924 | A1* | 4/2014 | Holden | 714/4.11 |
| 2014/0149221 | A1* | 5/2014 | Rycyna, III | 705/14.61 |

* cited by examiner

*Primary Examiner* — Julie Lieu
(74) *Attorney, Agent, or Firm* — Locke Lord LLP; Tim Tingkang Xia, Esq.

(57) ABSTRACT

One aspect of the present disclosure relates to an Emergency Alert System (EAS) display controller. The EAS display controller includes: (a) a processor, (b) a network interface controller configurable to be in communication with an out-of-band network, (c) a communication-interface controller configurable to be in communication with a signage device and in compliance with a control standard, a memory storing firmware. The firmware is configured to, when executed by the processor, (a) establish an out-of-band communication channel with at least one EAS message source, (b) receive an EAS message from the at least one EAS message source through the out-of-band channel, (c) extract an alert message from the EAS message, (d) construct a signage device control command in accordance with the control standard, and (e) send the command to the signage device to instruct the signage device to display the alert message.

25 Claims, 8 Drawing Sheets

EMERGENCY ALERT SYSTEM USING MANAGEMENT CONTROLLER IN NETWORK

FIELD

The present disclosure generally relates to an emergency alert system, and more particularly to an emergency alert system using an emergency alert system (EAS) display controller to display alert content on a signage device.

BACKGROUND

Typically, an emergency alert system is a public warning system that use different communication channels such us broadcasters, cable television systems, wireless cable systems, satellite digital audio radio service (SDARS), and direct broadcast satellite (DBS) to provide alert messages and content to the general public. The system also may be used by state and local authorities to deliver important emergency information, such as AMBER alerts and weather information targeted to specific areas.

There are millions of digital signage devices such as billboard, airport, hotel or restaurant signage displays, bulletin boards, currently in use. But currently there is no sophisticated mechanism that enables an EAS message source to display alert messages and content on signage devices.

Therefore, heretofore unaddressed needs still exist in the art to address the aforementioned deficiencies and inadequacies.

SUMMARY

One aspect of the present disclosure relates to an Emergency Alert System (EAS) display controller. In certain embodiments, the EAS display controller includes: (a) a processor, (b) a network interface controller configurable to be in communication with an out-of-band network, (c) a communication-interface controller configurable to be in communication with a signage device and in compliance with a control standard that the signage device supports, and (d) a memory storing firmware. When the firmware is executed by the processor, it is configured to, (a) establish an out-of-band communication channel with at least one EAS message source, (b) receive an EAS message from the at least one EAS message source through the out-of-band channel, (c) extract an alert message from the EAS message, (d) construct a signage device control command in accordance with the control standard to instruct signage device to display the alert message when the command is processed by the signage device, and (e) send the command to the signage device through the communication-interface controller for execution.

In certain embodiments, the signage device is configured to receive non-alert media content from a non-alert media content source through an in-band channel. The network interface controller is further configurable to (a) be in communication with an EAS display management device, and (c) receive management commands for configuring the EAS display controller from the EAS display management device.

In certain embodiments, the EAS display management device is a desktop EAS display management device or a mobile EAS display management device. The EAS display controller is configured to construct a signage device control command for displaying the alert message on the signage device based on at least one of: (a) a type of the alert message, (b) a source of the alert message, (c) a coverage area of the alert message, (d) an effective time of the alert message, and (e) a display format instructions of the alert message. The control standard includes POPAI Digital Signage Device RS-232 control standard.

In certain embodiments, the EAS message source includes a first EAS message source and a second EAS message source. The EAS display controller is configured to receive EAS messages from both the first and second EAS message sources.

In certain embodiments, the EAS display controller is configured to receive: (a) an EAS message from an EAS message source administrated at a federal government level, (b) an EAS message from an EAS message source administrated at a regional government level, and (c) an EAS message from an EAS message source administrated at a local government level. The EAS message is in accordance with a common alerting protocol (CAP), an XML-based data format. Each EAS message includes at least one of: (a) an alert message, (b) an alert message identifier, (c) an alert message sender's identifier, (d) an alert message status, (d) an alert message type, (e) an alert message scope, (f) an alert message information, (g) an event information, (h) a resource information, and (i) an alert message area information. The EAS message may also include a URI identifying a media file stored in a network storage. The EAS display controller is configured to retrieve the media file from the network storage and instruct the signage device to display media content of the media file. The media file includes a video file, an audio file, or an image file.

In certain embodiments, the signage device includes: (a) an in-band network configured to receive non-alert media content from a content provider, (b) a signage device controller (SDC) configured to receive non-alert media content and display the non-alert media content on the signage device, and receive EAS messages and display the EAS messages when emergency occurs, (c) a communication interface configured to receive EAS messages and control commands from the communication-interface controller of the EAS display controller for alert message display in accordance with the control standard, and (d) a signage display screen to display non-alert media content received and display the alert message when the EAS display controller receives an EAS message.

In certain embodiments, the EAS message is display by (a) a superimpose interface configured to superimpose the EAS message over the non-alert media content, and (b) a picture-in-picture (PIP) interface configured to display the EAS message and the non-alert media content using a picture-in-picture feature of the signage device. The superimpose interface includes: (a) a scrolling text interface configured to superimpose the EAS message in text form as a scrolling text over the non-alert media content at a predetermined location of the signage display screen of the signage device, (b) a still image interface configured to superimpose the EAS message in video, text or image form over the non-alert media content at a predetermined location of the signage display screen of the signage device, and (c) an audio message interface configured to superimpose the EAS message in audio form to audio channel of the signage device.

Another aspect of the present disclosure relates to an Emergency Alert System (EAS) display controller implemented method for managing signage display and alert content display on a signage device. The method includes: (a) receiving configuration requests from an EAS display management device by an operator to configure the EAS display controller for non-alert media content, (b) receiving configuration requests from the EAS display management device by the operator to configure the EAS display controller for alert content display, (c) receiving an EAS message at the EAS display controller from at least one EAS message source, (d) extracting an alert message from the EAS message and detail information of the EAS message, (e) determining whether and how to display the alert message based on the detail information of the EAS message, (f) delivering the alert message to a communication interface of the signage device for display if the EAS message is to be displayed, (g) constructing one or more control commands according to the display method determined and sending the control commands to the signage device through the communication interface of the signage device, (h) executing, at the signage device, the control commands from the EAS display controller to display the alert message, (i) terminating the alert content display, and (j) resuming the non-alert media content on the signage device.

In certain embodiments, the EAS display controller includes: (a) a processor, (b) a network interface controller configurable to be in communication with an out-of-band network, (c) a communication-interface controller configurable to be in communication with a signage device and in compliance with a control standard that the signage device supports, and (d) a memory storing firmware. When the firmware is executed by the processor, it is configured to, (a) establish an out-of-band communication channel with at least one EAS message source, (b) receive an EAS message from the at least one EAS message source through the out-of-band channel, (c) extract an alert message from the EAS message, (d) construct a signage device control command in accordance with the control standard to instruct signage device to display the alert message when the command is processed by the signage device, and (e) send the command to the signage device through the communication-interface controller for execution.

An additional aspect of the present disclosure relates to a non-transitory computer storage medium. The non-transitory computer storage medium stores computer-executable instructions. When executed by a processor of an Emergency Alert System (EAS) display controller, the computer-executable instructions cause the processor to: (a) receiving configuration requests from an EAS display management device by an operator to configure the EAS display controller for non-alert media content, (b) receiving configuration requests from the EAS display management device by the operator to configure the EAS display controller for alert content display, (c) receiving an EAS message at the EAS display controller from at least one EAS message source, (d) extracting an alert message from the EAS message and detail information of the EAS message, (e) determining whether and how to display the alert message based on the detail information of the EAS message, (f) delivering the alert message to a communication interface of the signage device for display if the EAS message is to be displayed, (g) constructing one or more control commands according to the display method determined and sending the control commands to the signage device through the communication interface of the signage device, (h) executing, at the signage device, the control commands from the EAS display controller to display the alert message, (i) terminating the alert content display, and (j) resuming the non-alert media content on the signage device.

BRIEF DESCRIPTION OF THE DRAWINGS

The accompanying drawings illustrate one or more embodiments of the disclosure and, together with the written description, serve to explain the principles of the disclosure. Wherever possible, the same reference numbers are used throughout the drawings to refer to the same or like elements of an embodiment, and wherein.

DETAILED DESCRIPTION

Figure 1:
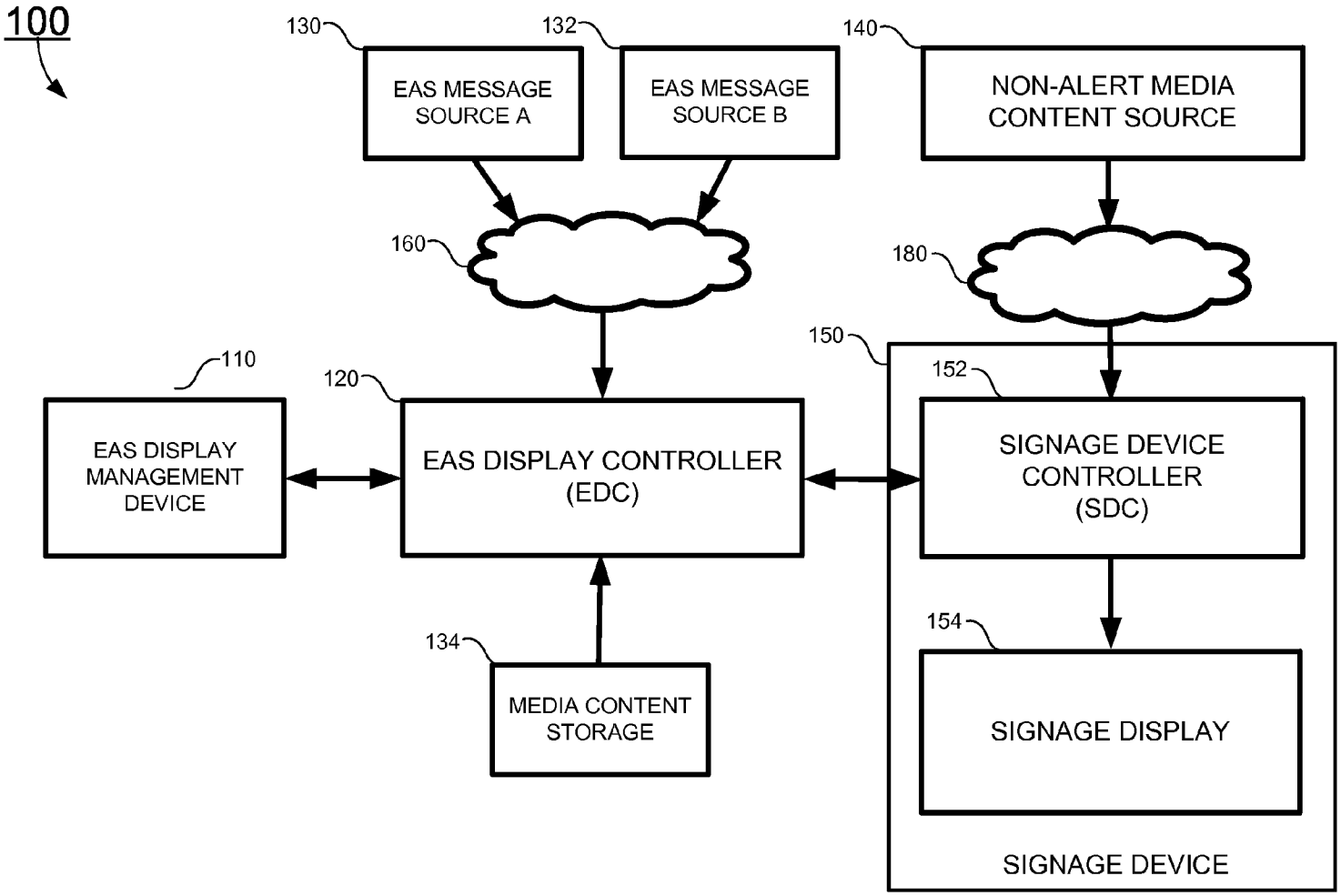
FIG. 1 shows a block diagram of an emergency alert system using an emergency alert system (EAS) display controller according to one embodiment of the present disclosure.

The present disclosure is more particularly described in the following examples that are intended as illustrative only since numerous modifications and variations therein will be apparent to those skilled in the art. Various embodiments of the disclosure are now described in detail. Referring to the drawings, like numbers, if any, indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present disclosure. Additionally, some terms used in this specification are more specifically defined below.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the disclosure or of any exemplified term. Likewise, the disclosure is not limited to various embodiments given in this specification.

Unless otherwise defined, all technical and scientific terms used herein have the same meaning as commonly understood by one of ordinary skill in the art to which this disclosure pertains. In the case of conflict, the present document, including definitions will control.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, "plurality" means two or more.

As used herein, the terms "comprising," "including," "carrying," "having," "containing," "involving," and the like are to be understood to be open-ended, i.e., to mean including but not limited to.

As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

As used herein, the term module may refer to, be part of, or include an Application Specific Integrated Circuit (ASIC); an electronic circuit; a combinational logic circuit; a field programmable gate array (FPGA); a processor (shared, dedicated, or group) that executes code; other suitable hardware components that provide the described functionality; or a combination of some or all of the above, such as in a system-on-chip. The term module may include memory (shared, dedicated, or group) that stores code executed by the processor.

The term code, as used above, may include software, firmware, and/or microcode, and may refer to programs, routines, functions, classes, and/or objects. The term shared, as used above, means that some or all code from multiple modules may be executed using a single (shared) processor. In addition, some or all code from multiple modules may be stored by a single (shared) memory. The term group, as used above, means that some or all code from a single module may be executed using a group of processors. In addition, some or all code from a single module may be stored using a group of memories.

The apparatuses and methods described herein may be implemented by one or more computer programs executed by one or more processors. The computer programs include processor-executable instructions that are stored on a non-transitory tangible computer readable medium. The computer programs may also include stored data. Non-limiting examples of the non-transitory tangible computer readable medium are nonvolatile memory, magnetic storage, and optical storage.

The present disclosure will now be described more fully hereinafter with reference to the accompanying drawings, in which embodiments of the disclosure are shown. This disclosure may, however, be embodied in many different forms and should not be construed as limited to the embodiments set forth herein; rather, these embodiments are provided so that this disclosure will be thorough and complete, and will fully convey the scope of the disclosure to those skilled in the art. Like numbers refer to like elements throughout.

Emergency Alert System (EAS) is a national public warning system that requires broadcasters, cable television systems, wireless cable systems, satellite digital audio radio service (SDARS) providers, and direct broadcast satellite (DBS) providers to provide the communications capability to the President to address the American public during a national emergency. The system also may be used by state and local authorities to deliver important emergency information, such as AMBER alerts and weather information targeted to specific areas. The Federal Communication Commission (FCC), in conjunction with Federal Emergency Management Agency (FEMA) and the National Oceanic and Atmospheric Administration's (NOAA) National Weather Service (NWS), implements the EAS at the federal level. The President has sole responsibility for determining when the EAS will be activated at the national level, and has delegated this authority to the director of FEMA. FEMA is responsible for implementation of the national-level activation of the EAS, tests, and exercises. The NWS develops emergency weather information to alert the public about imminent dangerous weather conditions, such as hurricane, snow storm, or tsunami warnings.

EAS messages are originated from various sources: (a) a federal level government source, (b) a regional or state level government source, and (a) local or municipality level government source. An EAS message such as a terror attack and a major earthquake may come from the federal government. An EAS message such as a severe weather warning, a minor earthquake warning, or an Amber alert can come from regional government (e.g. one or more states). A weather warning affecting small areas may come from a local government (e.g. metro area, or an area covering a few counties). An EAS display controller in accordance with certain embodiments of the present disclosure can receive EAS messages from all of these sources and other EAS message sources.

Generally, all analog radio and television stations, wired and wireless cable television systems, Direct Broadcast Satellite (DBS), Digital Television (DTV), Satellite Digital Audio Radio Service (SDARS), digital cable and Digital Audio Broadcasting (DAB), and wireline video systems operators are required under the FCC's rules to comply with EAS rules. Typically, EAS messages can come in various forms: (a) an EAS message received from a radio broadcasting network, (b) an EAS message received from a television broadcasting network, and (c) an EAS message received from IP TV, internet video program providers, and internet audio program providers. The radio broadcasting network includes AM radio networks, FM radio networks, digital radio networks, and satellite radio networks. The television broadcasting network includes very high frequency (VHF) and ultra-high frequency (UHF) terrestrial television broadcasting networks, cable television broadcasting networks, and satellite television broadcasting networks.

In certain embodiments, the EAS display controller can support EAS messages transmitted in a public network such as internet or a private secured network and can display alert messages and media content on one or more signage devices in accordance with the EAS messages.

In certain embodiments, the Common Alerting Protocol (CAP) can be adopted and supported by the EAS display controller 120. CAP is an XML-based data format for exchanging public warnings and emergencies between alerting technologies to help enable the consistent dissemination of EAS messages in a variety of formats (including text, audio and video) and via different transmission means (broadcast, cable, satellite, and other networks), as well as promote the development of Next Generation EAS. Adoption of CAP and the implementation of Next Generation EAS also will enable delivery of alerts to persons with disabilities and to non-English speakers.

An EAS message may include following elements:

"alert" element and sub-elements:

- Alert: the container for all component parts of the alert message;
- Identifier: the identifier of the alert message;
- Sender: the identifier of the send of the alert message;
- Sent: the time and date of the origination of the alert message;

Status: the code denoting the appropriate handling of the alert message;

msgType: the code denoting the nature of the alert message;

source: the text identifier of the source of the alert message (optional);

scope: the code denoting the intended distribution of the alert message;

restriction: the text describing the rule for limiting distribution of the restricted alert message (conditional);

addresses: the group listing of intended recipients of the alert message (conditional);

code: the code denoting the special handing of alert message (optional);

note: the text describing the purpose or significance of the alert message (optional);

references: the group listing identifying earlier message(s) referenced by the alert message (optional); and incidents: the group listing naming the referent incident(s) of the alert message (optional).

"info" element and sub-elements:

info: the container for all component parts of the info sub-element of the alert message (optional);

language: the code denoting the language of the info sub-element of the alert message (optional);

category: the code denoting the category of the subject event of the alert message;

event: the text denoting the type of the subject event of the alert message;

responseType: the code denoting the type of action recommended for the target audience (optional);

urgency: the code denoting the urgency of the subject event of the alert message;

severity: the code denoting the severity of the subject event of the alert message;

certainty: the code denoting the certainty of the subject event of the alert message;

audience: the text describing the intended audience of the alert message (optional);

eventCode: a system-specific code identifying the event type of the alert message (optional);

effective: the effective time of the information of the alert message (optional);

onset: the expected time of the beginning of the subject event of the alert message (optional);

expires: the expiry time of the information of the alert message (optional);

senderName: the text naming the originator of the alert message (optional);

headline: the text headline of the alert message (optional);

description: the text describing the subject event of the alert message (optional);

instruction: the text describing the recommended action to be taken by recipients of the alert message (optional);

web: the identifier of the hyperlink associating additional information with the alert message (optional);

contact: the text describing the contact for follow-up and confirmation of the alert message (optional); and parameter: a system-specific additional parameter associated with the alert message (optional).

"resource" element and sub-elements:

resource: the container for all component parts of the resource sub-element of the info sub-element of the alert element (optional);

resourceDesc: the text describing the type and content of the resource;

mimeType: the identifier of the Multipurpose Internet Mail Extensions (MIME) content type and sub-type describing the resource file;

size: the integer indicating the size of the resource file (optional);

uri: the identifier of the hyperlink for the resource file (optional);

derefUri: the base-64 encoded data content of the resource file (conditional); and digest: the code representing the digital digest ("hash") computed from the resource file (optional).

"area" element and sub-elements:

area: the container for all component parts of the area sub-element of the info sub-element of the alert message (optional);

areaDesc: the text describing the affected area of the alert message;

polygon: the paired values of points defining a polygon that delineates the affected area of the alert message (optional);

circle: the paired values of a point and radius delineating the affected area of the alert message (optional);

geocode: the geographic code delineating the affected area of the alert message (optional);

altitude: the specific or minimum altitude of the affected area of the alert message (optional); and ceiling: the maximum altitude of the affected area of the alert message (conditional).

As indicated above in the parentheses, some of the elements and sub-elements are required, and some of the elements and sub-elements are optional.

FIG. 1 shows a block diagram of an emergency alert system 100 according to one embodiment of the present disclosure. In certain embodiments, the emergency alert system 100 includes: (a) an Emergency Alert System (EAS) display controller 120, (b) an EAS display management device 110, (c) a first EAS message source 130, (d) a second EAS message source 132, (e) a alert media content storage 134, (f) a non-alert media content source 140, and (e) a signage device 150.

Figure 2:
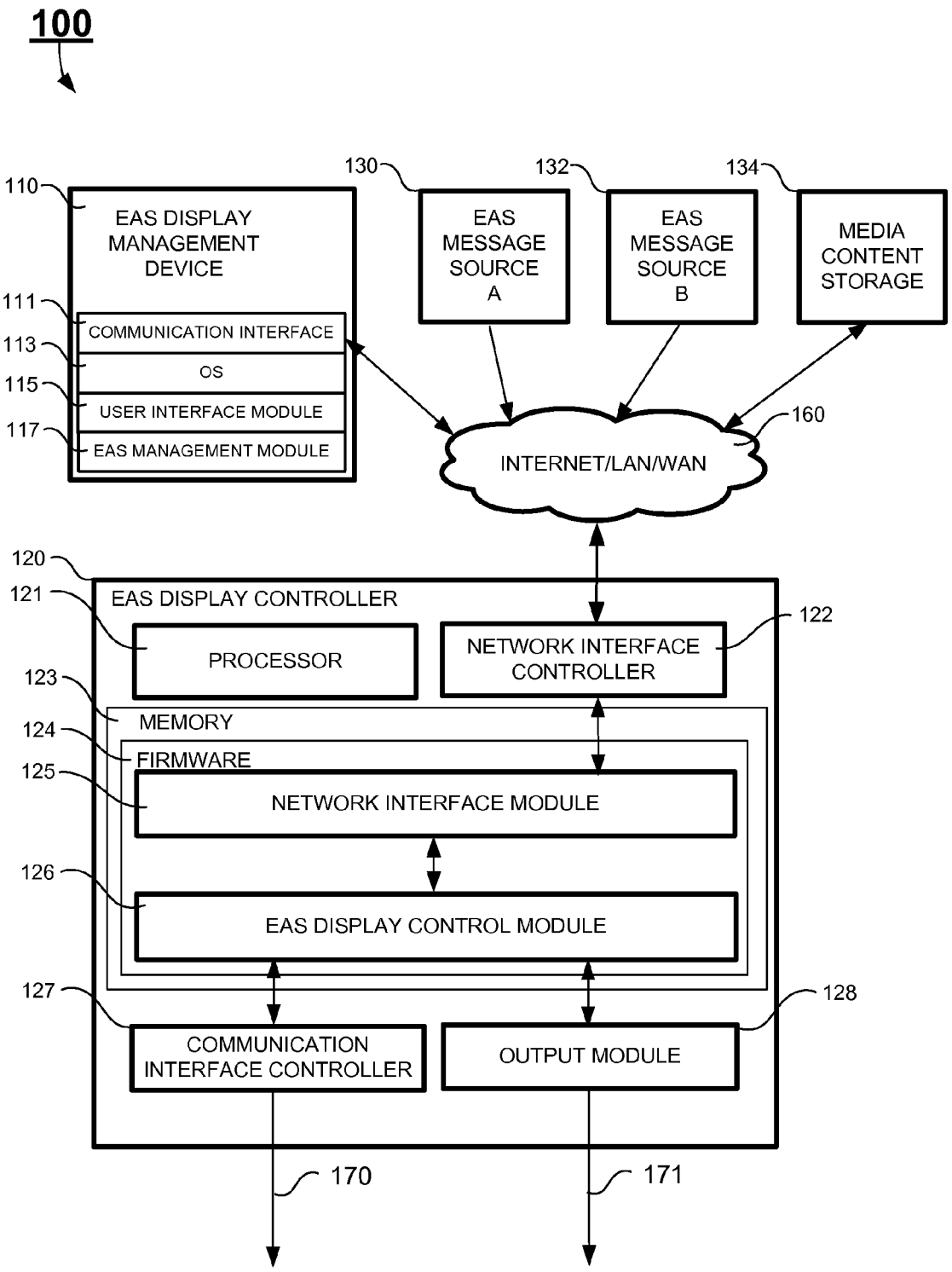
FIG. 2 shows an exemplary structure of the EAS display controller, EAS message sources, and an EAS display management device according to one embodiment of the present disclosure.

FIG. 2 shows an exemplary structure of the EAS display controller 120, the first EAS message source 130, the second EAS message source 132, the alert media content storage 134, and the EAS display management device 110 according to one embodiment of the present disclosure.

In certain embodiments, the signage device normally displays signage content from a non-alert media content source 140. The non-alert media content source 140 can provide media content such as television programming, advertisement content, image and text display, etc. The communication between the non-alert media content source 140 and the signage device 154 are considered as in-band communication.

The first EAS message source 130 and the second EAS message source 132 can be administrated by different entities. For example, the first EAS message source 130 and the second source 132 can be administrated by various level of governmental agencies, such as a national primary station, a regional or a state primary station, or a local or municipality primary station. As described earlier, the EAS message can be received in an XML file format. It can include text messages such as "TORNADO WARNING IS ISSUED FOR XXX COUNTY, PLEASE SEEK SHELTER IMMEDIATELY." It can also include uniform resource identifier (URI) or other storage location identifiers of one or more media files including audio, video, and/or image files. The media files are usually stored in a media storage accessible through internet, such as the alert media content storage 134 shown in FIG. 2. The EAS display controller 120 can be configured to retrieve a URI from an EAS message, and retrieve the media file from the URI and store the media file in the memory 123 of the EAS display controller 120.

The EAS display management device 110 is configured for an operator to manage EAS display over a signage device. As shown in FIG. 2, the EAS display management device 110 has a communication interface 111, an operating system 113, a user interface module 115, and an EAS management module 117. The EAS display management device 110 can be a desktop computer based management device, or a handheld smart phone based management device.

In certain embodiments, the desktop computer based management device 110 includes one or more operating systems as well as one or more application programs. The operating system has a set of programs that control operations of the desktop computer based management device 110. The set of application programs, inclusive of certain utility programs, may also provide a graphical user interface module 115 to the operator. The operating system is operable to multitask, i.e., execute computing tasks in multiple threads, and thus may be any of the following: MICROSOFT CORPORATION's "WINDOWS XP" or "WINDOWS NT", "WINDOWS Vista,", "WINDOWS 7," and "WINDOWS 8," operating systems, IBM's OS/2 WARP, APPLE's MACINTOSH OSX operating system, LINUX, UNIX, etc.

In certain embodiments, a handheld smart phone based management device 110 can include one or more operating systems as well as one or more application programs. The operating system has a set of programs that control operations of the handheld smart phone based management device 110. The set of application programs, inclusive of certain utility programs, may also provide a graphical user interface module 115 to the operator. The operating system is operable to multitask, i.e., execute computing tasks in multiple threads, and thus may be any of the following: MICROSOFT CORPORATION's "WINDOWS PHONE", APPLE's IOS operating system, and GOOGLE's ANDROID operating system.

The communication interface 111 can connect to a network through a local area network (LAN), a wide area network (WAN), a Wi-Fi network, a Bluetooth or a Zigbee personal area network (PAN).

In certain embodiments, the user interface module 115 can generate various user interfaces (UIs) and display the UIs on the display screen of the EAS display management device 110. The UIs allows an operator to enter various user inputs for operating and configuring the EAS display controller 120. In certain embodiments, the user interface module can generate and display a login screen. The login screen for example has a username field, a password field, and field for entering a network address of an EAS display controller 120. The UI module receives username and password entered by the operator. Upon the operator presses an "enter" button on the login screen, the user interface module 115 of the construct a user-authentication input and calls an input-executing function of the EAS management module 117 to pass the input to the EAS management module 117. As will be described in detail below, the input-executing function of the EAS management module 117 processes the user-authentication input and in response returns an execution result to the UI module. In response to a user-authentication input, the result can be an "access granted" message when the user is authenticated by the EAS display controller 120, or an "access denied" message when user is not authenticated. Accordingly, the UI module can display those messages on the display screen of the EAS display management device 110.

In certain embodiments, after the operator login to the EAS display controller 120, the operator may want the user interface module to list the signage devices connected to the EAS display controller 120.

The user interface module 115 of the EAS display management device 110 can be used to configure the setting of the EAS display controller 120. Followings are a few examples of the settings of the EAS display controller 120:

configurations of the alert message display on the signage device based on the type or the nature of the alert message. For example, if the alert message is a short text message, the EAS display controller 120 can be configured to display the alert message through a superimposed interface with non-alert media content in the forms of rolling text, superimposed text message, through close caption. If the alert message is a media file including audio, video and images and it is retrieved from a media storage over the internet, the EAS display controller 120 can be configured to display the alert message with non-alert media content in the form of picture in picture, or replace the non-alert media content with the display of the media file.

configurations of the alert message display on the signage device based on the source of the alert message. For example, if the alert message is from a federal level, the EAS display controller 120 can be configured to display the alert message through a superimposed interface with non-alert media content in the forms of rolling text, superimposed text message, through close caption. If the alert message is a media file including audio, video and images, the EAS display controller 120 can be configured to display the alert message with non-alert media content in the form of picture in picture, or replace the non-alert media content with the display of the media file retrieved through internet.

configurations of the alert message display on the signage device based on the coverage area of the alert message. For example, if the alert message is intended to be distributed nation-wide, the EAS display controller 120 can be configured to display the alert message immediately after the alert message is activated. If the alert message is intended to be distributed in a regional, state or local area, the EAS display controller 120 can be configured to check the location of the signage device against the designated coverage area of the alert message, and determine whether the signage device is within the coverage area, and the signage device should be used to display the alert message.

configurations of the alert message display on the signage device based on the effective date and time of the alert message. If the alert message includes an info field specifying an effective date and time, the EAS display controller 120 can be configured to check the current date and time, and start the alert message display at the date and time specified by the alert message info field. If the alert message includes an info field specifying an onset date and time, and expiration date and time, the EAS display controller 120 can be configured to start the alert message display at the onset date and time, and stop the alert message display at the expiration date and time. If the effective date and time, the onset date and time, and the expiration date and time are not specified, the EAS display controller 120 can be configured to display the alert message one time as soon as the alert message is received.

configurations of the alert message display on the signage device based on the instructions of the alert message. For example, if the info field instructions contains specific instructions such as repeat alert message every 5 minutes, and the source of the media file is retrieved from the internet, then the EAS display controller 120 can be configured to retrieve the media file from the internet, buffer the media file in the memory of the EAS display controller 120, display the alert message at specified time, and repeat at a predetermined interval as specified in the instructions info field.

Other settings of the EAS display controller 120 are possible and are not listed here. These settings are usually communicated from the user interface module 115 to the EAS display controller 120 through the network interface controller of the EAS display controller 120, and they can be stored in a non-volatile memory 123 of the EAS display controller 120. The memory 123 of the EAS display controller 120 can also be used to store or buffer media file retrieved from the network.

In certain embodiments, the EAS display controller 120 includes: a processor 121, a network interface controller 122, a memory 123, a communication interface controller 127, and an output module 128.

The processor 121 is configured to receive EAS messages from various source of the EAS message, to decode the received EAS messages, manage the display of the EAS messages according to the setting and configuration of the operator, construct control commands to signage devices according to a control standard such as POPAI digital signage device RS-232 control standard, and transmit the alert message and the control commands to the signage device to display the alert message.

In certain embodiments, the network interface controller 122 is configured to receive. Through the a communication network 160, management commands from the EAS display management device 110, and receive EAS messages from the EAS message sources 130, 132, and receive media files from the alert media content storage 134. The communication protocol can be IP protocol or other communication protocols. The communication network 160 may be IP based, and can be an LAN, a WAN, and/or a Wi-Fi network.

In certain embodiments, the EAS display controller 120 is an out-of-band service processor or management controller, and communicates with the EAS display management device 110 through an out-of-band network. In other words, the communication network 160 can be separate from or independent of the network used for transmitting the non-alert media content from the non-alert media content source 140 to the signage device 150. Further, the communication network 160 can be a secured network that requires a proper authentication from a party that desires to deliver a message through with the communication network 160 to the EAS display controller 120.

In certain embodiments, the memory 123 includes at least firmware 124. In certain embodiments, the firmware 124 can include an operating system or a kernel that manages hardware and software resource for the modules and components described below. In case of an operating system, it can be any one of the following: WINDOWS XP, WINDOWS Vista, WINDOWS 7, and WINDOWS 8, OS/2 WARP, MACINTOSH OS X, LINUX, UNIX, etc.

The firmware 124, when executed by the processor 121 of the EAS display controller 120, can include a network interface module 125 for, among other things, receiving EAS messages from various EAS message sources, retrieving media files from the media storage on the internet, and receiving configuration commands from the EAS display management device 110.

In certain embodiments, the firmware 124 of the EAS display controller 120 has an EAS display control module 126 for performing all control functions of the EAS display controller 120 on the signage device 150, and for displaying the alert message received according to the detail information in the EAS message.

The communications between the EAS display controller 120 and the signage device 150 typically are through a wired connection, but in certain circumstances can be through a wireless connection.

In one embodiment, the communications between the EAS display controller 120 and the EAS display management device 110 can be in accordance with the IPMI protocol or other suitable communication protocols. The communications between the EAS display controller 120 and signage device 150 are in accordance POPAI's Digital Signage Device RS 232 Control Standard or some other proprietary communication protocols. Optionally, the communication can also use networks such as LAN, WAN, or as simple as a telephone line, or wireless, such as mobile communication networks such as CDMA, GPRS cellular networks, or satellite communication network, or a combination of both wired and wireless to allow the distance between the EAS display controller 120 and the signage device to extend beyond direct RS-232 cable connections.

In certain embodiments, the EAS display control module 126 of the EAS display controller 120 is configured to receive EAS messages from the first EAS message source 130, and the second EAS message source 132 over the network 160 and the network interface controller 122;

retrieve a media file from a media storage based on a URI embedded in the EAS message over the network 160 and the network interface controller 122;

accept configuration commands from the EAS display management device 110 to configure the setting of EAS display;

construct a control command according to a control standard to control the signage device to display the alert message and media files; and transmit the alert messages to the signage device for display.

In certain embodiments, the operator uses an EAS display management device 110 to set up the basic parameters of the signage device 150 in the EAS display control module 126. These parameters include: the model, the name of the signage device, the location of the signage device, the basic audio and video display configurations, and many others.

In certain embodiments, the EAS display control module 126 can receive the EAS messages, through the network interface controller 122, from the EAS message sources 130, 132. For example, the EAS message sources 130, 132 can have knowledge of the IP addresses of the one or more EAS display controller 120s. The EAS message sources 130, 132 can encapsulate the EAS messages in one or more IP packets addressed to the one or more EAS display controller 120s, and then send the IP packets to the communication network 160.

In certain embodiments, the firmware 124 can have necessary routines or functions that extract the EAS messages from the receive IP packets and then send the extracted EAS messages to the EAS display control module 126. The EAS display control module 126, after receiving the EAS messages, can parse the EAS messages and obtain the elements and the sub-elements described above.

In general, each of the EAS messages can include one or more of an alert content, type, nature, source, coverage area, effective time, urgency level, severity level, intended audience, category and type of the emergency event, and audio-and-video-playback-setting elements. Accordingly, the EAS display control module 126 are configurable, e.g. in accordance with the configuration commands received from the EAS display management device 110, to display the alert message based on one or more of the elements.

Other settings of the EAS display control module 126 are also possible. These settings are usually communicated from the user interface module 115 to the EAS display controller 120 through the network interface controller 122 of the EAS display controller 120, and they are stored in the memory 123 of the EAS display controller 120. The memory 123 of the EAS display controller 120 can also be used to store or buffer a media file retrieved from the internet instead of constantly retrieving the media file. The memory 123 can include a volatile memory and a non-volatile memory. When the EAS receives an EAS message, the EAS display controller 120 will manage and control the EAS display based on the settings.

The EAS display controller 120 is set up to determine whether the EAS message received will be display, what display formats to use for alert content display, and for how long, or how many time according to the configuration setting of the signage device, and the information contained in the EAS message.

As discussed above, the information element of the EAS message may include a coverage area. The EAS message is intended to be displayed only in the area specified in the area description of the information element. The operator can use the EAS display management device 110 to configure the location of the signage device at the EAS display control module 126. When the EAS display control module 126 receives an EAS message, the EAS display control module 126 of the EAS display control module 126 extracts the area description of the EAS message. If the EAS message does not contain the area description, the EAS message can be interpreted to be displayed by all signage device 150s by default. If the EAS message includes an area description, then the EAS message is intended only to the area specified in the area description. The EAS display control module 126 of the EAS display control module 126 compares the area description and the location of the signage device. If the location of the signage device falls into the area description, then the EAS display control module 126 construct one or more control commands to set up the alert content display. Otherwise, if the location of the signage device does not fall into the area description, then the EAS display control module 126 can ignore the EAS message and continue with the non-alert media content.

In addition to the signage device parameters configuration, the operator can also use the EAS display management device 110 to configure the alert content display settings of the EAS display controller 120. These settings include:

(a) under what conditions (area description, urgency, certainty, audience, effective date and time, onset date and time, expiration date and time, restrictions, etc.) the signage device should display the EAS message received;

(b) how the EAS messages are received and decoded;

(c) how and where to retrieve and store the media file;

(d) in what format the received EAS message should be displayed;

(e) how to deliver the EAS messages to the signage device; and (f) use what control commands to display the EAS messages in various formats.

These parameters are stored in the non-volatile portion of the memory 123 of the EAS display controller 120.

As an illustrative example, the EAS display control module 126 can perform one or more of the following functions:

(a) setting up the non-alert media content parameters of the signage device 150 by an operator through an EAS display management device 110;

(b) setting up the alert content display parameters of the signage device 150 by the operator through the EAS display management device 110;

(c) displaying non-alert media content as desired by the owner/operator of the signage device 150;

(d) receiving an EAS message when an emergency occurs over the network interface controller 122, and decode the EAS message;

(e) retrieving a media file from a media storage accessible through a communication network and storing the file locally in a portion of non-volatile memory, where the location of the media file is indicated by a URI embedded in the resource description field of the EAS message;

(f) based on the alert level and nature of the EAS message, determining whether the EAS message is displayed on the signage device and which display method is to be used to display the alert content;

(g) constructing one or more control commands according to the determination above;

(h) sending the alert content to the signage device through the control-communication interface 155 or the second signage media input 157;

(i) sending the control commands to the signage device to facilitate the alert content display through communication interface controller 127 and the control-communication interface 155;

(j) sending the alert content to the signage device according to the displaying method determined; and (k) terminating alert content display.

The EAS display control module 126 of the EAS display controller 120 can be configured to construct a control command to control the alert content display. FIG. 4 shows a few exemplary displays of an AMBER Alert message on a signage device according to certain embodiments of the present disclosure, including:

(4A) scrolling text display at a predetermined location of the display screen, (4B) text or video display in the form of picture in picture (PIP) at an operator configurable location of the display screen, (4C) text display superimposed onto the current display, and (4D) full screen display.

Standard POPAI command sets can be used to display the alert messages. For example, to display the received alert message in a picture in picture format on the signage device, the EAS display control module 126 can provide the alert message over a video input and send a command (e.g., "02 00 00 01 00 45 01 01 03") to turn on the picture in picture feature of the signage device. To display the alert message in a full screen mode of the signage device, the EAS display control module 126 can construct an corresponding command (e.g. "02 00 00 01 00 02 01 01 03") to switch to display the alert message in full screen of the signage device.

In certain embodiments, the signage device 150 can provide providing a superimpose interface that can be utilized to superimpose texts or images on the non-alert media content (e.g., and advertisement) shown on the signage device 150. The EAS display controller 120 can communicate with the superimpose interface and send alert texts and media files to the superimpose interface. The signage device 150 then superimpose the alert texts and media files one the non-alert media content.

In certain embodiments, the audio adjustments and video adjustments can also be implemented through the control commands from the EAS display control module 126. When an urgent alert message is to be displayed (or announced) and the signage device is turned off, the EAS display control module 126 can construct a turn-on command (e.g., "02 00 00 01 00 01 01 01 03") and send the turn-on command to the signage device to turn on the signage device. Further, the EAS display control module 126 can construct a volume-control command (e.g., "02 00 00 01 00 08 01 64 03") and send the volume-control command to the signage device to turn up the audio volume to 100% on the signage device.

In certain embodiments, the EAS display controller 120 can provide a web server application program. Thus, the EAS display controller 120 can receive and respond to requests to perform management function via a web interface and for example through HTTP/HTTPS protocol.

The EAS display controller 120 can have a communication interface controller 127 for communicating with the signage device 150 over a communication link 170. The communication interface controller 127 is configured to transmit the alert messages, and the control commands to the signage device 150 according to a control standard such as POPAI Digital Signage Devices RS-232 Control Standard. For example, the communication interface controller 127 can output control signals through a RS-232 port. The communication interface controller 127 is in communication with a control-communication interface 155 of the signage device 150 through a communication link 170.

In certain embodiments, the EAS display controller 120 can include an output module 128. The EAS display control module 126 can utilize the output module 128 to out, for example, the video signals. Particularly, the EAS display control module 126 can generate video signals representing the alert messages and content, including the alert media content, and output the video signals to the output module 128. In certain embodiments, the output module 128 is in communication with the second signage media input 157 of the signage device 150 through a communication link 171.

The signage device 150 can be used for displaying non-alert media content normally and, when an emergency occurs, EAS messages. Although a singular signage device 150 is discussed here, the signage device 150 can be expanded to multiple signage devices by connecting them in certain manners. For example, the signage devices can be daisy chained together according to the POPAI Digital Signage Device RS-232 Control Standard.

Figure 3:
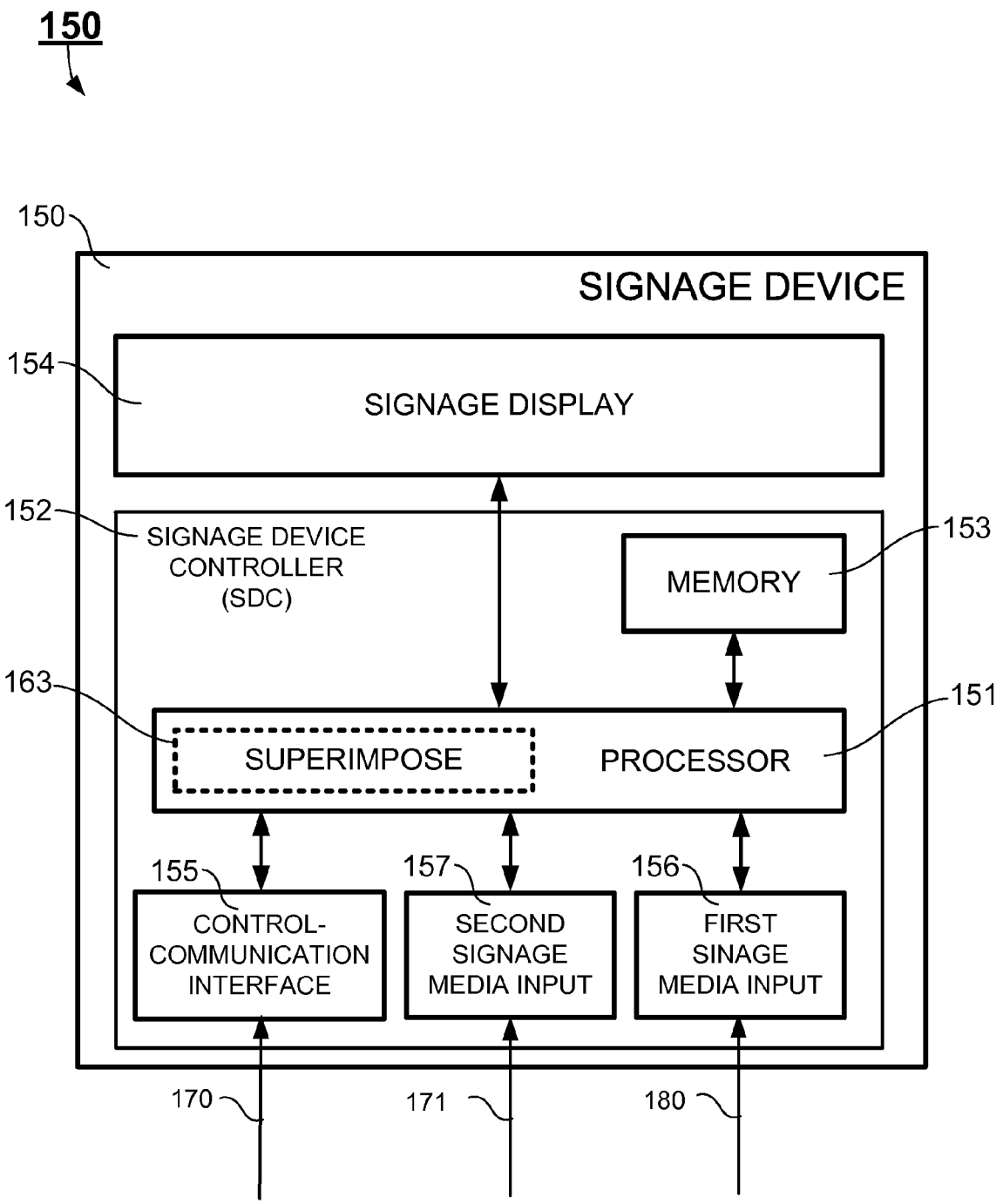
FIG. 3 shows a block diagram of an exemplary structure of a signage device according to one embodiment of the present disclosure.

FIG. 3 shows a block diagram of an exemplary structure of a signage device 150 according to one embodiment of the present disclosure. In certain embodiments, the signage device 150 includes a signage device controller 152, and a signage display 154.

The signage device controller 152 has a central processor 151, a memory 153, a first signage media input 156, a second signage media input 157, and a control-communication interface 155. The memory 153 includes a portion of non-volatile memory for storing firmware, other application programs, and system configuration and other data, and a portion of volatile memory for buffering data and system operation.

In certain embodiments, the signage device controller 152 of the signage display 150 is in communication with a non-alert media content source 140 through an in-band network 180. The non-alert media content source 140 delivers the content to be displayed at the signage display to the first signage media input 156 through the in-band communication network 180.

The first signage media input 156 is connected to an in-band network 180 to receive non-alert media content from the non-alert media content source 140. The control-communication interface 155 of the signage device 150 is connected to the communication interface controller 127 of the EAS display controller 120 for (a) receiving control commands for managing and controlling the signage device, and (b) receiving EAS messages received at the EAS display controller 120.

In one embodiment, the EAS messages are received at the EAS display controller 120, and processed and stored in the memory 123. The alert content is passed to the signage device 150 through the communication interface controller 127 and a communication link 170. The signage device controller 152 receives the EAS messages through the control-communication interface 155 in communication with the communication link 170.

In certain embodiments, the EAS display controller 120 sends the alert content to the signage device 150, via the communication link 171, to the second signage media input 157 (e.g. a video or HDMI input) of the signage device 150.

The alert content can be displayed on the signage device 150 in many different manners. FIGS. 4A through 4D are a few exemplary displays of an AMBER Alert message on a signage device according to certain embodiments of the present disclosure.

Figure 4A:
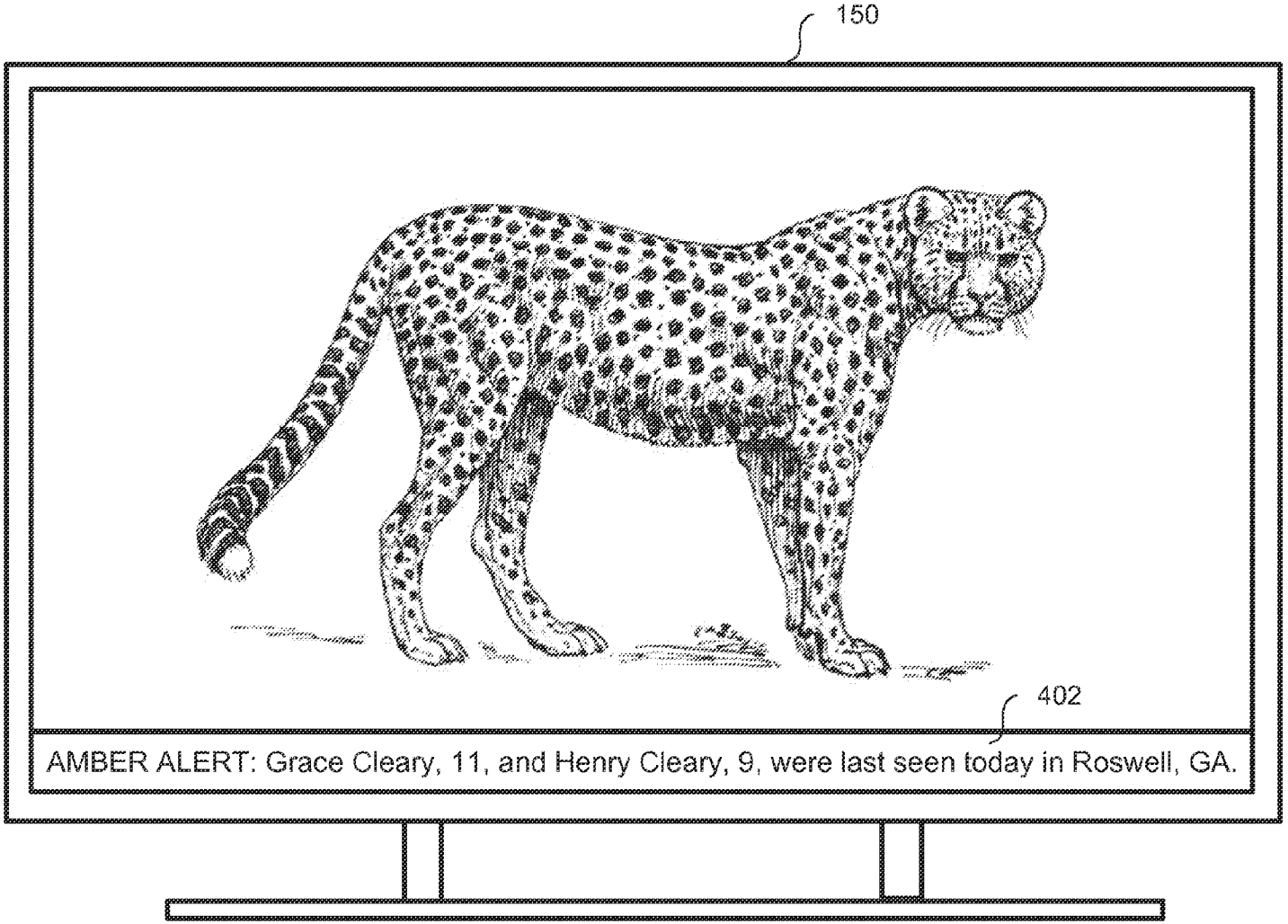
FIGS. 4A through 4D shows exemplary displays of alert content on a signage device according to certain embodiments of the present disclosure.

In FIG. 4A, a scrolling EAS text message 402 is displayed at the bottom of the display screen 150. This may require that the signage device be able to superimpose the text EAS message onto the non-alert media content as scrolling text. This superimposing ability can be implemented through a superimpose module 163.

Figure 4B:
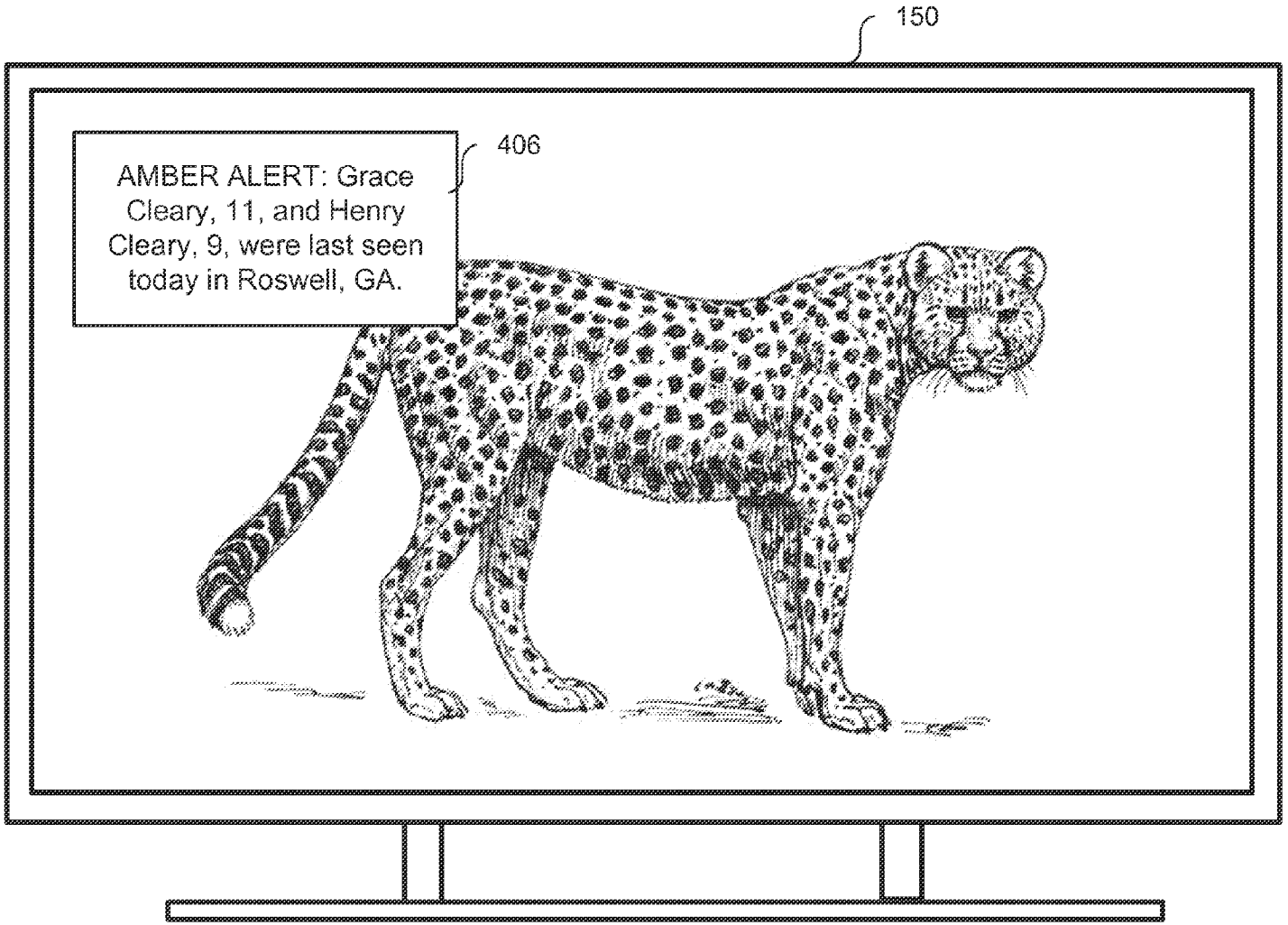

In FIG. 4B, a text or video display 406 is shown in the form of picture in picture (PIP) at a designated location of the signage device 150. This may require that the signage device have picture in picture capability.

Figure 4C:
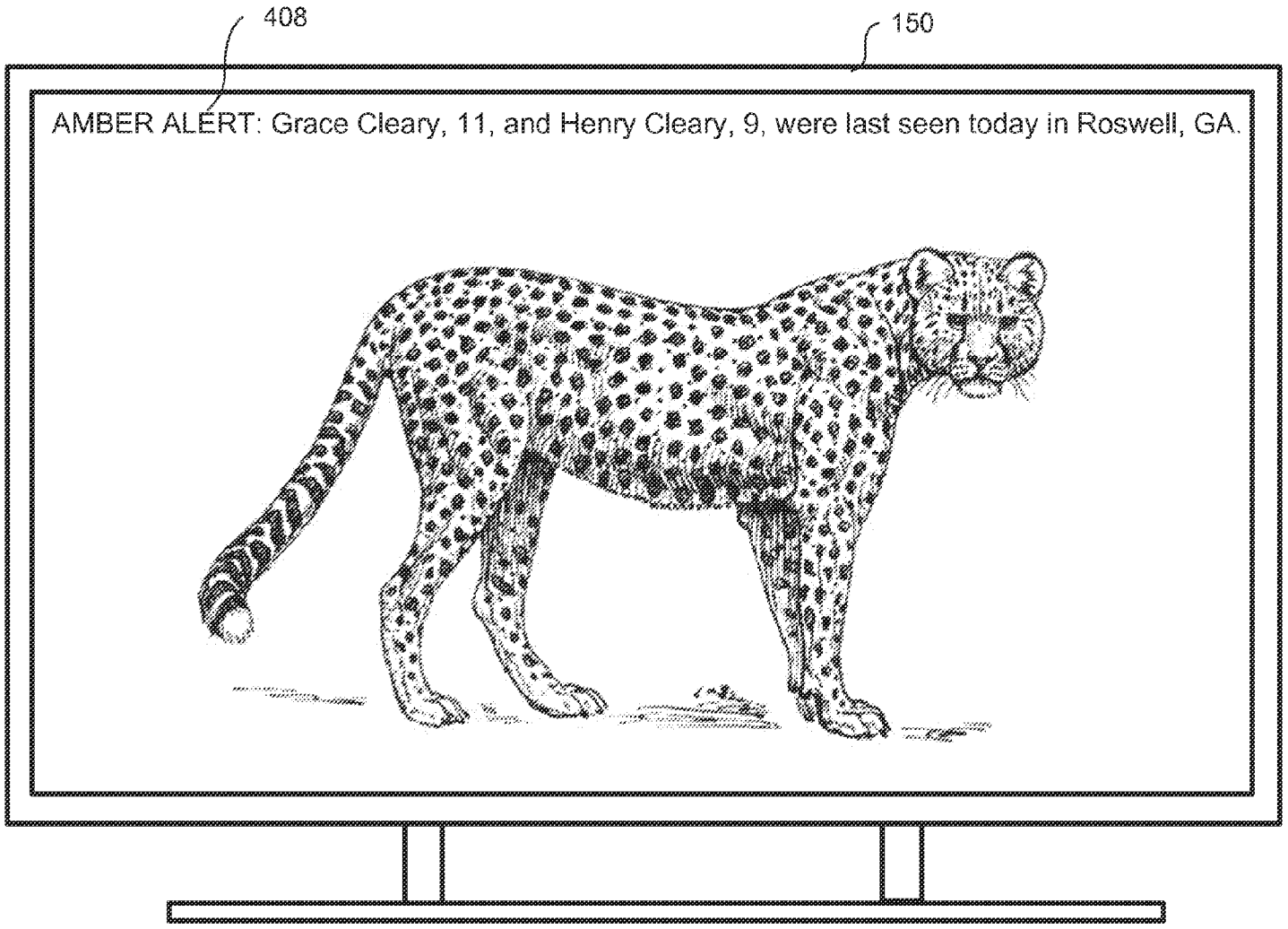

In FIG. 4C, an EAS text message display 408 is superimposed on the top of the current display screen 402. This may require that the signage device be able to superimpose the text/video/image EAS message onto the non-alert media content. This superimposing ability can be implemented through a superimpose module 163.

Figure 4D:
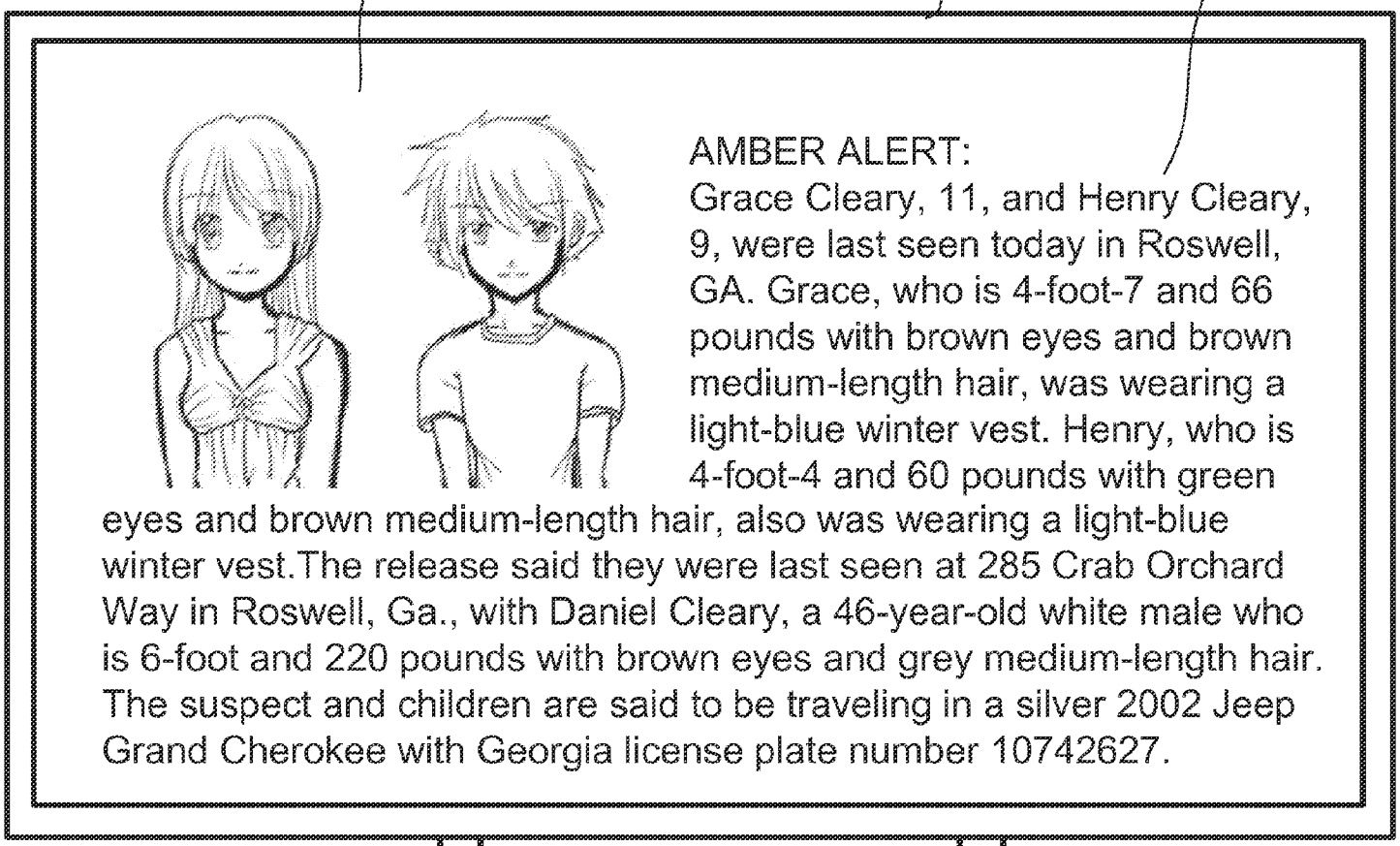

In FIG. 4D, a full screen text/image/video display 412 is displayed on the entire screen 402. This method can be implemented by simply replacing the normal signage display with the alert content display.

In certain embodiments, as shown in FIG. 2, the EAS display controller 120 has an output module 128 (e.g., Audio/Video output or an HDMI output) in communication with the EAS display control module 126. The output module 128 can be connected to the second signage media input 157 of the signage device. The EAS message can be displayed to the picture in picture through one or more control commands such as selecting the signage media input 156 (non-alert media content), the second input source 157 (EAS message), and turning on the picture in picture feature. When the alert content display is over, the EAS display controller 120 can send a control command to turn off the picture in picture feature of the signage device.

To implement a full screen display of alert content, the EAS display controller 120 can send a control command to switch the signage media input 156 (non-alert media content) to the second signage media input 157 (EAS message), and switch back when the alert content display is over.

In certain embodiments, the processor 151 of the signage device controller 152 can optionally include a hardware superimpose module 163 or execute a software superimpose module 163. For example, the superimpose module 163 of the signage device controller 152 can perform one or more of following functions:

(a) receiving the alert message in text form from the control-communication interface 155 of the signage device;

(b) receiving the non-alert media content from the first signage media input 156 of the signage device controller 152 of the signage device; and (c) superimposing the EAS text message onto the non-alert media content as a rolling text display at an operator configurable location of the signage display screen.

FIG. 4A shows displaying EAS message in text message form as a rolling text at a predetermined location of the signage display screen, e.g., at the bottom of the signage display screen or the top of the signage display screen.

In certain embodiments, the superimpose module 163 of the EAS display controller 120 performs following functions:

(a) receiving the alert content in text/video/image form from an audio/video input source or the second signage media input 157 of the signage device;

(b) receiving the non-alert media content from the first signage media input 156 of the signage device; and (c) superimposing the alert content onto the non-alert media content as a video display at an operator configurable location of the signage display screen.

FIG. 4B shows displaying alert content from a media file such as video, image or text message superimposed onto the non-alert media content at a predetermined location of the signage display screen, e.g., near the upper left/right corner, or near the lower left/right corner of the signage display screen.

In certain embodiments, the EAS display management device 110 may include a web browser (not shown in FIGS. 1, 2, and 3), such as the INTERNET EXPLORER web browser from MICROSOFT CORPORATION of Redmond, Wash., or SAFARI web browser from APPLE INC of Palo Alto, Calif., that enables the EAS display management device 110 to communicate over the Internet, local area network (LAN), wide area network (WAN) with the EAS display controller 120.

Figure 5:
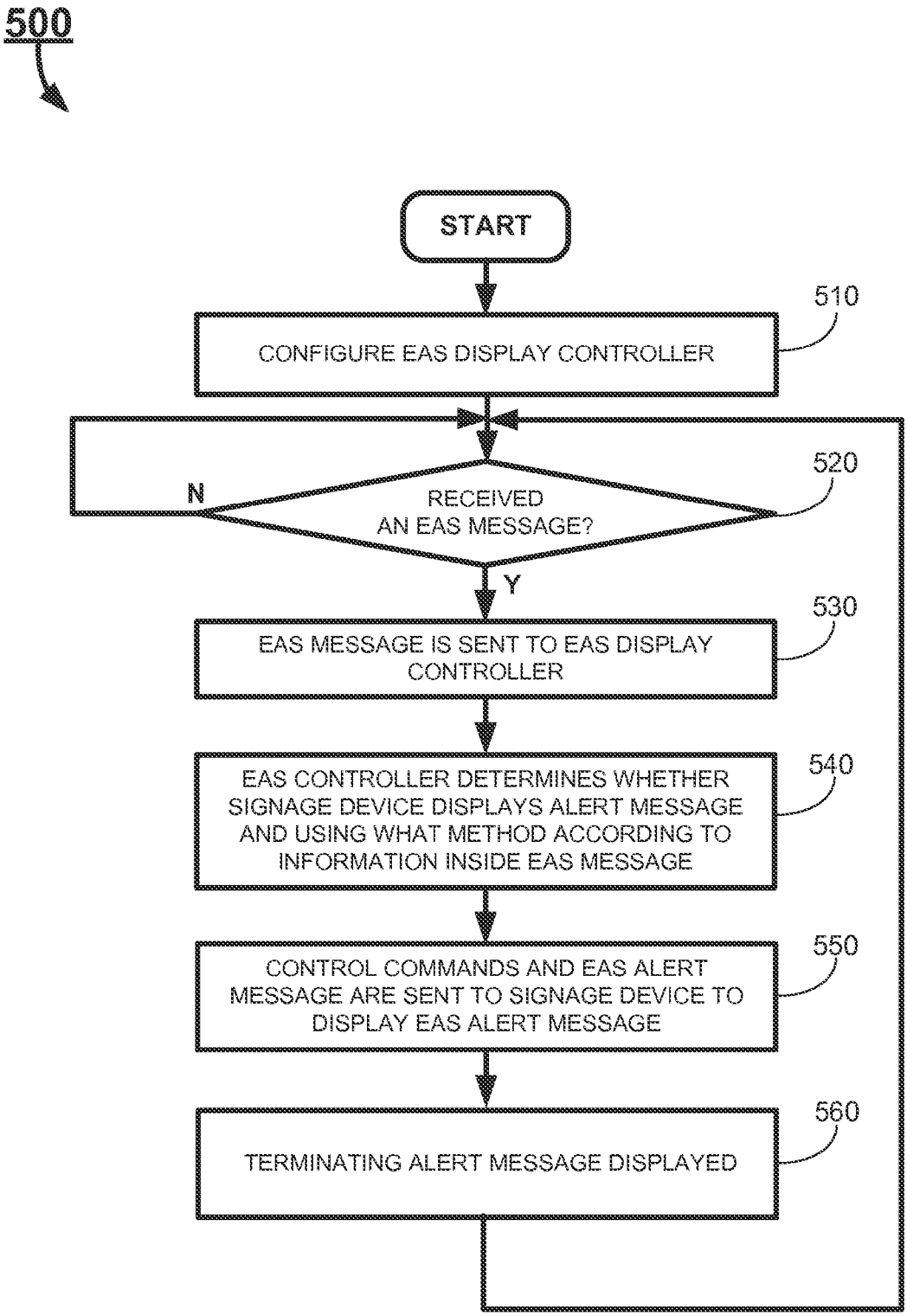
FIG. 5 shows a flow chart of operations of an exemplary Emergency Alert System having an EAS display controller according to one embodiment of the present disclosure.

FIG. 5 shows a flow chart 500 of exemplary operations of an emergency alert system using an EAS display controller 120 according to certain embodiments of the present disclosure. At operation 510: at the start of the EAS system 100, an operator uses an EAS display management device 110 to configure the EAS display controller 120, including the configuration of the signage device for non-alert media content, and the configuration of the alert content display. These configuration settings are stored at a non-volatile portion of the memory of the EAS display controller 120. The signage device displays non-alert media content from a signage media content source normally.

At operation 520: The EAS display controller 120 waits for EAS messages at this step. It loops back to operation 520 if there is no EAS message received. When an emergency occurs, an EAS message is received over the network interface controller 122 of the EAS display controller 120 and it proceeds to operation 530.

At operation 530: the EAS message is decoded and sent to the EAS display controller 120.

At operation 540: when the EAS display controller 120 receives the EAS message, the detail information of the EAS message is examined by the EAS display control module 126, and the EAS display control module 126 determines whether and in what format the EAS message is displayed based on the information of the EAS message such as the coverage area, the date and time, the EAS message type, restrictions, and instructions.

At operation 550: once the EAS display controller 120 has determined how to display the EAS message, the EAS display control module 162 constructs one or more control commands and send the control commands to the signage device to display the EAS message. Further, the alert message can be extracted from the EAS message and delivered to the signage device for display.

At operation 560: the EAS display controller 120 determines that the alert message display should be terminated, and it sends corresponding control commands to the signage display, which can resume display non-alert media content. The EAS display controller 120 returns to operation 520 and continues monitoring EAS messages.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope. Accordingly, the scope of the present disclosure is defined by the appended claims rather than the foregoing description and the exemplary embodiments described therein.

What is claimed is:

1. A system, comprising:

a signage device supporting a control standard, the signage device comprising:

a signage device controller in communication with a non-alert media content source via an in-band network; and a signage display; and an Emergency Alert System (EAS) display controller separated from the signage device, the EAS display controller comprising:

a processor;

a network interface controller configurable to be in communication with at least one EAS message source via an out-of-band network, wherein the out-of-band network is separate from or independent from the in-band network;

a communication-interface controller configurable to be in communication with the signage device controller via a communication link, wherein the communication-interface controller is in compliance with the control standard; and a memory storing firmware which is configured to, when executed by the processor, establish an out-of-band communication channel with the at least one EAS message source via the out-of-band network;

receive an EAS message from the at least one EAS message source through the out-of-band communication channel;

extract an alert message from the EAS message;

construct a signage device control command in accordance with the control standard; and send the signage device control command to the signage device through the communication-interface controller, wherein the signage device controller is configured to:

receive the signage device control command from the EAS display controller, and execute the signage device control command;

receive a non-alert media content from the non-alert media content source via the in-band network; and in response to executing the signage device control command and receiving the non-alert media content, display the alert message and the non-alert media content on the signage display.

2. The system of claim 1, further comprising:

an EAS display management device in communication with the EAS display controller via a network, the EAS display management device being configured to send management commands to the network interface controller to configure the EAS display controller.

3. The system of claim 2, wherein the EAS display management device is a desktop EAS display management device or a mobile EAS display management device.

4. The system of claim 1, wherein the EAS display controller is configured to construct the signage device control command for displaying the alert message on the signage device based on at least one of:

a type of the alert message;

a source of the alert message;

a coverage area of the alert message;

an effective time of the alert message; and a display format instructions of the alert message.

5. The system of claim 1, wherein the control standard comprises POPAI Digital Signage Device RS-232 control standard.

6. The system of claim 1, wherein the EAS message source includes a first EAS message source and a second EAS message source; and wherein the EAS display controller is configured to receive the EAS messages from both the first and second EAS message sources.

7. The system of claim 1, wherein the EAS display controller is configured to receive:

the EAS message from the EAS message source administrated at a federal government level;

the EAS message from the EAS message source administrated at a regional government level; and the EAS message from the EAS message source administrated at a local government level.

8. The system of claim 7, wherein the EAS message is in accordance with a common alerting protocol (CAP), an XML-based data format; and wherein the EAS message comprises at least one of:

an alert message;

an alert message identifier;

an alert message sender's identifier;

an alert message status;

an alert message type;

an alert message scope;

an alert message information;

an event information;

a resource information; and an alert message area information.

9. The system of claim 1, wherein the EAS message comprises a URI identifying a media file stored in a network media content storage, and wherein the EAS display controller is configured to retrieve the media file from the network media content storage and instruct the signage device to display media content of the media file.

10. The system of claim 9, wherein the media file is a video file, an audio file, or an image file.

11. The system of claim 1, wherein the EAS message is displayed by:

a superimpose interface configured to superimpose the EAS message over the non-alert media content; and a picture-in-picture (PIP) interface configured to display the EAS message and the non-alert media content using a picture-in-picture feature of the signage device.

12. The system of claim 11, wherein the superimpose interface comprises:

a scrolling text interface configured to superimpose the EAS message in text form as a scrolling text over the non-alert media content at a predetermined location of the signage display of the signage device;

a still image interface configured to superimpose the EAS message in video, text or image form over the non-alert media content at a predetermined location of the signage display of the signage device; and an audio message interface configured to superimpose the EAS message in audio form to audio channel of the signage device.

13. A method for managing signage display and alert content display on a signage device, comprising:

establishing, at an Emergency Alert System (EAS) display controller, an out-of-band communication channel with at least one EAS message source, wherein the EAS display controller is separated from the signage device, wherein the out-of-band communication channel is established via an out-of-band network;

receiving, at the EAS display controller, an EAS message from the at least one EAS message source through the out-of-band communication channel;

extracting, at the EAS display controller, an alert message from the EAS message;

constructing, at the EAS display controller, a signage device control command in accordance with a control standard, wherein the signage device supports the control standard; and sending, by the EAS display controller, the signage device control command to a signage device controller of the signage device through a communication interface controller of the EAS display controller, wherein the communication interface controller is in compliance with the control standard, and is configured to be in communication with the signage device controller via a communication link;

wherein the signage device controller is in communication with a non-alert media content source via an in-band network, and is configured to:

receive the signage device control command from the EAS display controller, and execute the signage device control command;

receive a non-alert media content from the non-alert media content source via the in-band network; and in response to executing the signage device control command and receiving the non-alert media content, displaying the alert message and the non-alert media content on a signage display of the signage device, wherein the out-of-band network is separate from or independent from the in-band network.

14. The method of claim 13, wherein the EAS display controller comprises:

a processor;

a network interface controller configurable to be in communication with the at least one EAS message source via the out-of-band network;

the communication-interface controller; and a memory storing firmware which is configured to, when executed by the processor, perform the method.

15. The method of claim 13, wherein the network interface controller is further configurable to be in communication with the EAS display management device via a network, wherein the EAS display management device is configured to send management commands to the network interface controller to configure the EAS display controller.

16. The method of claim 13, wherein the EAS display management device is a desktop EAS display management device or a mobile EAS display management device.

17. The method of claim 13, wherein the EAS display controller is configured to construct the signage device control command for displaying the alert message on the signage device based on at least one of:

a type of the alert message;

a source of the alert message;

a coverage area of the alert message;

an effective time of the alert message; and a display format instructions of the alert message.

18. The method of claim 13, further comprising:

receiving, at the EAS display controller, first configuration requests from an EAS display management device to configure the EAS display controller for non-alert media content display; and receiving, at the EAS display controller, second configuration requests from an EAS display management device to configure the EAS display controller for alert content display.

19. The method of claim 13, further comprising:

extracting, at the EAS display controller, detail information of the EAS message from the EAS message; and determining, at the EAS display controller, a display method about whether and how to display the alert message based on the detail information of the EAS message;

wherein the signage device control command is constructed according to the display method determined.

20. The method of claim 13, wherein the signage device controller is further configured to:

terminate the alert content display; and resume the non-alert media content on the signage display.

21. A non-transitory computer storage medium having computer-executable instructions stored thereon, wherein the computer-executable instructions, when executed by a processor of an Emergency Alert System (EAS) display controller, are configured to:

establish an out-of-band communication channel with at least one EAS message source, wherein the out-of-band communication channel is established via an out-of-band network;

receive an EAS message from the at least one EAS message source through the out-of-band communication channel;

extract an alert message from the EAS message;

construct a signage device control command in accordance with a control standard, wherein a communication interface controller of the EAS display controller is in compliance with the control standard, and the signage device supports the control standard; and send the signage device control command from the EAS display controller to a signage device supporting the control standard through a communication interface controller of the EAS display controller, wherein the EAS display controller is separated from the signage device, and wherein the communication interface controller is in compliance with the control standard, and is configured to be in communication with a signage device controller of the signage device via a communication link;

wherein the signage device controller is in communication with a non-alert media content source via an in-band network, and is configured to:

receive the signage device control command from the EAS display controller, and execute the signage device control command;

receive a non-alert media content from the non-alert media content source via the in-band network; and in response to executing the signage device control command and receiving the non-alert media content, displaying the alert message and the non-alert media content on a signage display of the signage device, wherein the out-of-band network is separate from or independent from the in-band network.

22. The non-transitory computer storage medium of claim 21, wherein the computer-executable instructions are further configured to:

receive first configuration requests from an EAS display management device to configure the EAS display controller for non-alert media content display; and receive second configuration requests from an EAS display management device to configure the EAS display controller for alert content display.

23. The non-transitory computer storage medium of claim 21, wherein the computer-executable instructions are further configured to:

extract detail information of the EAS message from the EAS message; and determine a display method about whether and how to display the alert message based on the detail information of the EAS message;

wherein the signage device control command is constructed according to the display method determined.

24. The non-transitory computer storage medium of claim 21, wherein the signage device controller is further configured to:

terminate the alert content display; and resume the non-alert media content on the signage display.

25. The non-transitory computer storage medium of claim 21, wherein the EAS display controller comprises:

the processor;

a network interface controller configurable to be in communication with the at least one EAS message source via the out-of-band network;

the communication-interface controller; and the non-transitory computer storage medium storing the computer-executable instructions.

* * * * *